US005237310A

United States Patent [19]

Smith

[11] Patent Number: 5,237,310

[45] Date of Patent: Aug. 17, 1993

[54] PUMP MONITOR

[75] Inventor: Michael Smith, Manitoba, Canada

[73] Assignee: Inco Limited, Toronto, Canada

[21] Appl. No.: 807,997

[22] Filed: Dec. 16, 1991

[30] Foreign Application Priority Data

Jan. 28, 1991 [CA] Canada ..... 2035080

[51] Int. Cl.[5] ..... G08B 21/00

[52] U.S. Cl. ..... 340/679; 340/605; 340/608; 417/63

[58] Field of Search ..... 340/679, 608, 606, 605, 340/603, 540; 417/63

[56] References Cited

U.S. PATENT DOCUMENTS

| | | | |
|---|---|---|---|
| 3,739,367 | 6/1973 | Fathauer | 340/679 |
| 3,855,480 | 12/1974 | Striker et al. | 307/118 |
| 4,321,461 | 3/1982 | Walter, Jr. et al. | 340/608 |
| 4,595,342 | 6/1986 | Christlieb et al. | 417/45 |
| 4,642,614 | 2/1987 | Cook | 340/608 |

*Primary Examiner*—Glen R. Swann, III
*Attorney, Agent, or Firm*—Edward A. Steen

[57] ABSTRACT

A monitor (10) includes a transducer (20) registered with a pump (22) for generating electrical signals reflecting the status of the pump (22). The output of the transducer (20) is conditioned by a pump monitor circuit (16) to indicate the status (18) of the pump (22) and for subsequent delivery to an alarm processing unit (C) and alarm condition (D). The monitor (10) reports both normal and abnormal pump (22) conditions.

12 Claims, 4 Drawing Sheets

PUMP MONITOR

TECHNICAL FIELD

The instant invention relates to fluid pumping systems in general, and more particularly, to an apparatus for monitoring the operating status of a pump pumping fluids through a pipe.

BACKGROUND ART

In order to insure the safety and integrity of critical pumping systems, there exist various sophisticated techniques for monitoring the operation of the pumps, valves, pipes, etc. constituting these systems. Detecting changes in flow rate, fluid pressure, flow speed, volume, etc., flow excursions beyond acceptable limits result in shutdowns, reroutings, pressure relief and other measures to protect personnel, equipment and ongoing processes.

For flow systems of arguably less critical stature, more basic and less expensive warning systems are utilized. Oftentimes nothing more than an infrequent physical inspection of the various components is attempted. Under these circumstances, an irregular condition may not be detected for a long period of time, possibly resulting in the ruination of an industrial process or equipment with the attendant economic loss.

Unfortunately, as far as the applicant is aware, there are no low cost, simple means for detecting whether reciprocating metering pumps are operating properly.

In particular, applicant is aware of an unrequited need to install monitoring means on metering pumps that would indicate to remotely situated operators whether or not these pumps are operating properly. In the past, these pumps would fail and the operators would not be aware of the difficulty for several hours until downstream chemical processes deteriorated due to the lack or excess of the appropriate fluids reaching their destinations.

Initially, attempts were made to use pressure switches affixed to the discharge ends of the pumps. These would close when a predetermined pressure was achieved; that is, when the pump pumped, a status signal would be seen in the control booth.

Inasmuch as these switches were relatively expensive—on the order of $250–$350; required a high degree of skill to install; and were estimated to require an inordinate amount of maintenance, it was decided to develop the instant invention.

SUMMARY OF THE INVENTION

Accordingly, there is provided a simple, low cost pump monitor that indicates the status of an associated pump. A transducer, in communication with a pump, generates an amplified electrical signal responsive to the action of the pump that is compared to a selectable threshold value. Upon reaching this threshold value, a suitable visual or audible signal is produced either confirming correct pump function or indicating problems with the pump or in the flow system.

PREFERRED MODE FOR CARRYING OUT THE INVENTION

Figure 1:
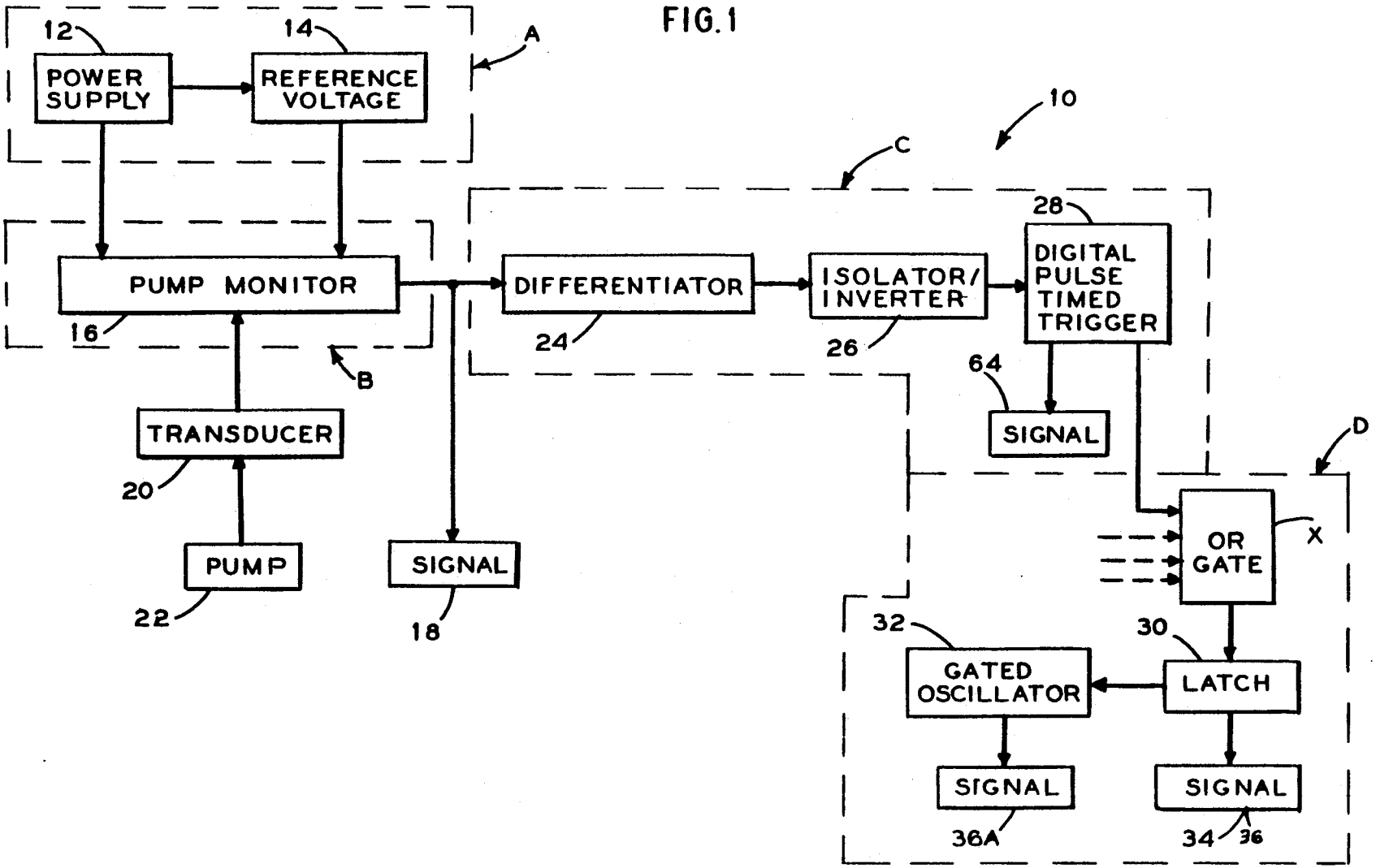
FIG. 1 is a block diagram of an embodiment of the invention.

Referring to FIG. 1, there is shown a pump monitoring apparatus 10.

Simply for the purposes of discussion, the apparatus 10 may be subdivided into four non-limiting sections.

Section A includes a power supply 12 and a source 14 for a reference voltage $V_{REF}$. Section B includes a pump monitor 16. A transducer 20, affixed to a pump 22, communicates with the pump monitor 16. Although not shown, section A also supplies power and the $V_{REF}$ to the transducer 20. The pump monitor 16 in turn is connected to a signal 18 and a series of components broadly constituting an alarm processing unit—section C.

Section C includes a differentiator 24, an isolator/inverter 26, a digital pulse timed trigger 28, and an alarm status signal 64.

The trigger 28 is connected to section D.

Section D, broadly constituting an alarm conditioner, includes an OR gate X, a RS latch (or flip-flop) 30, and a gated oscillator 32. The oscillator 32 communicates with a number of indicating signal devices 36A. The latch 30 communicates with signal devices 34 and 36.

The apparatus 10 is designed to inform a remote operator as to the status of the pump 22. Every time the pump 22 pumps, the signal 18, preferably a light emitting diode D9, blinks in concert with the pump action. Depending on the configuration, if the transducer 20 senses a loss of pressure caused, say by pump failure, or a closed, ruptured pipe upstream or downstream the pump 22, the light 18 will remain off. If there is a blockage downstream the pump 22 resulting in a pressure rise, the light 18 will stay on. Only when the pump 22 is operating properly and the fluid flow is normal will the light 18 blink in time with the pump 22; the rate of flashing provides a proportional estimate of the pump speed.

Abnormal behavior of the pump 22 will be indicated by the light 18 and further by the signals 34, 36 and 64, which are also lights, and the signal 36A which is an audible alarm. Should any pump component start to fail, the operation of the pump 22 will generally change and be detected by the signals before total pump failure occurs. In this fashion the pump 22 may be inspected and repaired before catastrophic pump and process failure occurs.

Figure 2:
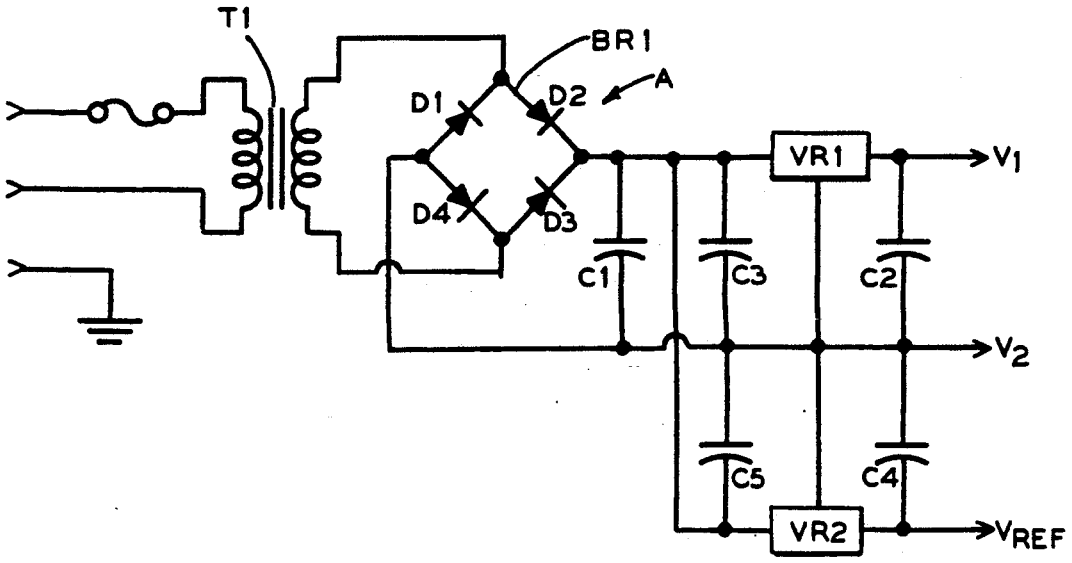
FIG. 2 is a schematic diagram of a power supply and reference voltage source.

Referring to FIG. 2, section A provides both power and the reference voltage $V_{REF}$ to the apparatus 10.

Fused AC power (i.e. 115 volts) is supplied to transformer T1 which is connected to quad diode bridge BR1. The bridge BR1, including diodes D1–D4, rectifies the alternating current to direct current. Voltage regulator VR1 provides 15 volts DC ($V_1$). Voltage regulator VR2 provides a 5 volt DC reference voltage ($V_{REF}$). The capacitors C1–C5 operate in standard fashion and reduce any transients in the rectified DC outputs. Voltage $V_2$ is 0 volts.

Figure 3:
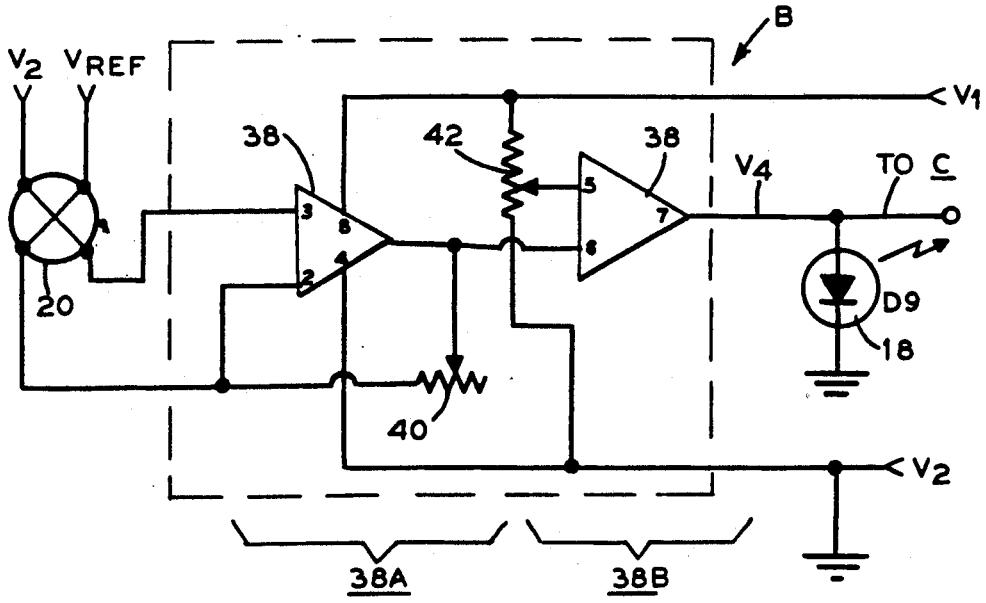
FIG. 3 is a schematic diagram of a pump monitor.

Turning to FIG. 3, $V_{REF}$(5 volts) and $V_2$ (0 volts) are supplied to the transducer 20. The small pulsed output signal of the transducer 20, a function of the pump's output and on the order of about 30–120 millivolts, is amplified depending on the setting of potentiometer 40 to a higher useful pulsed voltage (4 to 10 volts) by dual operational amplifier 38 acting both as an amplifier 38A and an A/D converter 38B. The converter section 38B then sends out a digital "high" sign (on) $V_4$ (which is equal to $V_1$) when the amplified signal reaches a predetermined threshold valve determined by the setting of potentiometer 42. In other words, the potentiometer 40 sets the gain of the amplifier 38A and the potentiometer 42 sets the threshold trigger level from 0–15 volts. If the gain of amplifier 38A is above, say 6 volts (or any other voltage dialed in by potentiometer 42), an impulse initiated by the pulsed square wave signal $V_4$ is to light emitting diode (LED) D9 located in signal 18 and further to the alarm process unit C. The LED D9 will blink in time with the pump 22. It is preferred that it be red so that the operator at the console will see its steady rhythm.

Figure 4:
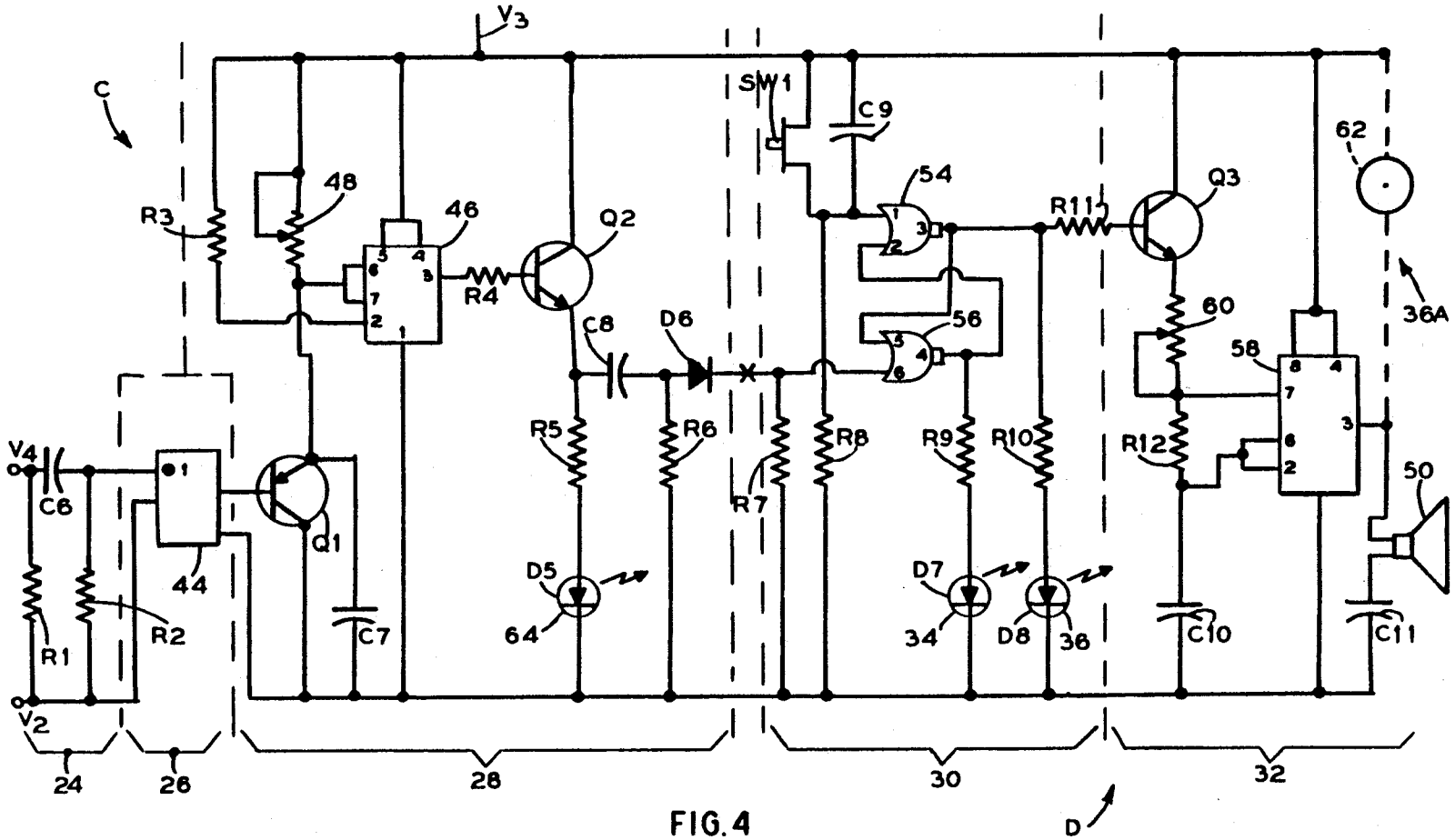
FIG. 4 is a schematic diagram of an alarm processing unit and an alarm conditioner.

Referring now to FIG. 4, the signal that is directed toward the LED D9 (18) is also supplied toward the alarm processing unit C. A source of voltage $V_3$ (generally 9 volts) powers the alarm processing unit C. Although $V_3$ may be provided by the power supply 12, it is preferred to have an alternative source (not shown) in the event of a power interruption or spike so as to protect the components of the sections C and D.

The differentiator 24, comprised of resistors R1 and R2 and capacitor C6, receives the pulsing on/off square wave signal $V_4$, converts it to a pulsed spiked signal, and passes it on to the isolator/inverter 26. The apparatus 10 is designed to consider a repetitive spiked signal as normal. A repeating spiked signal, constantly resets timer 46.

If a pump failure or a related event occurs, causing either continuous high $V_4$ or zero voltage, the capacitor C6 will not discharge. The differentiator 24 will simply pass a constant $V_4$ to the isolator/inverter 26. The subsequent circuitry will recognize this as a failure condition.

The isolator/inverter 26 includes an optocoupler 44 having an internal LED and a phototransistor (neither are shown). The spiked $V_4$ blinks the internal LED which in turn turns the internal transistor on and off in the same sequence. As a consequence, the spiked, pulsed input to the isolator/inverter 26 is inverted and isolated from the original source and is passed onto the digital pulse timed trigger 28. A continuous or zero $V_4$ input will result in a similar, non-pulsed output thereby indicating trouble.

The digital pulse timed trigger 28 consists of PNP transistor Q1 and NPN transistor Q2 associated with a 555 timer 46, and time delay circuit 48. Also included are resistors R3–R6, LED D5 (64), diode D6, and capacitors C7–C8.

The timer 46 senses a delay between the output of the transistor Q1 and the delayed signal from the variable time delay 48. After the timer 46 is turned on by the delay, if it does not receive the next signal from Q1 within an appropriate time set by the delay 48, the transistor Q2 is energized, the alarm status signal 64 turned on and the various alarms are activated. On the other hand, as long as the pump 22 is properly pumping it initiates the repeating electrical signal turning the LED D9 (18) on and off in time with the beats of the pump 22. A blinking LED D9 (18) means everything is OK. The alarm status signal 64 is off. The various resistors and capacitors in the trigger 28 operate in a standard fashion to protect the internal components and provide the appropriate current.

The output of the trigger 28 is directed via diode D6 to a multiple input OR gate symbolized by X. Up to this point the apparatus 10 may include a plurality of pumps 22 with individually dedicated pump monitors 16, differentiators 24, signals 18 and 64, isolator/inverters 26 and triggers 28, each string of components culminating in a single input to the OR gate X. A single OR gate X, latch 30 and oscillator 32 may be common to the plurality of inputs feeding the OR gate X. The OR gate X, in a sense, besides activating the downstream circuit components also acts as a funnel.

The RS latch 30 includes a flip-flop consisting of two NOR gates 54 and 56, a reset switch SW1, resistors R7–R10, capacitor C9 and LED's D7 (34) and D8 (36). D7 is preferably green and D8 is preferably red. The latch 30 is configured to energize the LED D7 (34) when the system status is normal. That is, it continuously glows green (while D9 is blinking and D5 is off) indicating the system is both armed and operating normally. In the event that transistor Q2 is activated, LED D9 will stop flashing, LED D5 will glow identifying a specific failure, the LED D7 (34) will turn off and the LED D8 (36) will continuously glow red indicating a general fault due to a pump failure, a valve failure, etc. Upon recognition of the problem, the red LED D8 (36) can be turned off, thereby re-energizing the green LED D7 (34) by depressing the reset switch SW1.

To further drive home the point that there is a problem with one of the fluid pumps 22 or related equipment, the output of NOR gate 54 may also be connected to the NPN transistor Q3 which is part of the gated oscillator 32. The oscillator 32 includes a second 555 timer 58, a variable tone control 60, speaker 50, resistors R11 and R12, and capacitors C10 and C11.

Upon a detected failure, the LED D8 (36) and the transistor Q3 will simultaneously be switched on. The transistor Q3 will activate the timer 58 to generate an oscillating tone signal to the speaker 50 (signal 36A). This unstable configuration will cause the speaker 50 to generate a oscillatory tone. Without the timer 58, the speaker would simply hum, rendering it nearly impossible to hear.

Furthermore, based upon an increasing number of anecdotal reports showing that warning devices are often intentionally disabled, it is preferable to also add an optional piezoelectric buzzer 62 that emits an ear piercing warning.

As was alluded to earlier, the OR gate X may process inputs from a plurality of pump monitors 16. For the purposes of illustration only, FIG. 4 shows only one input or channel.

Letting "Y" equal the number of pump monitors, there will be an equivalent number Y of associated alarm processing units C but only one common OR gate X, latch 30, and oscillator 32; i.e. one alarm conditioner D.

Figure 5:
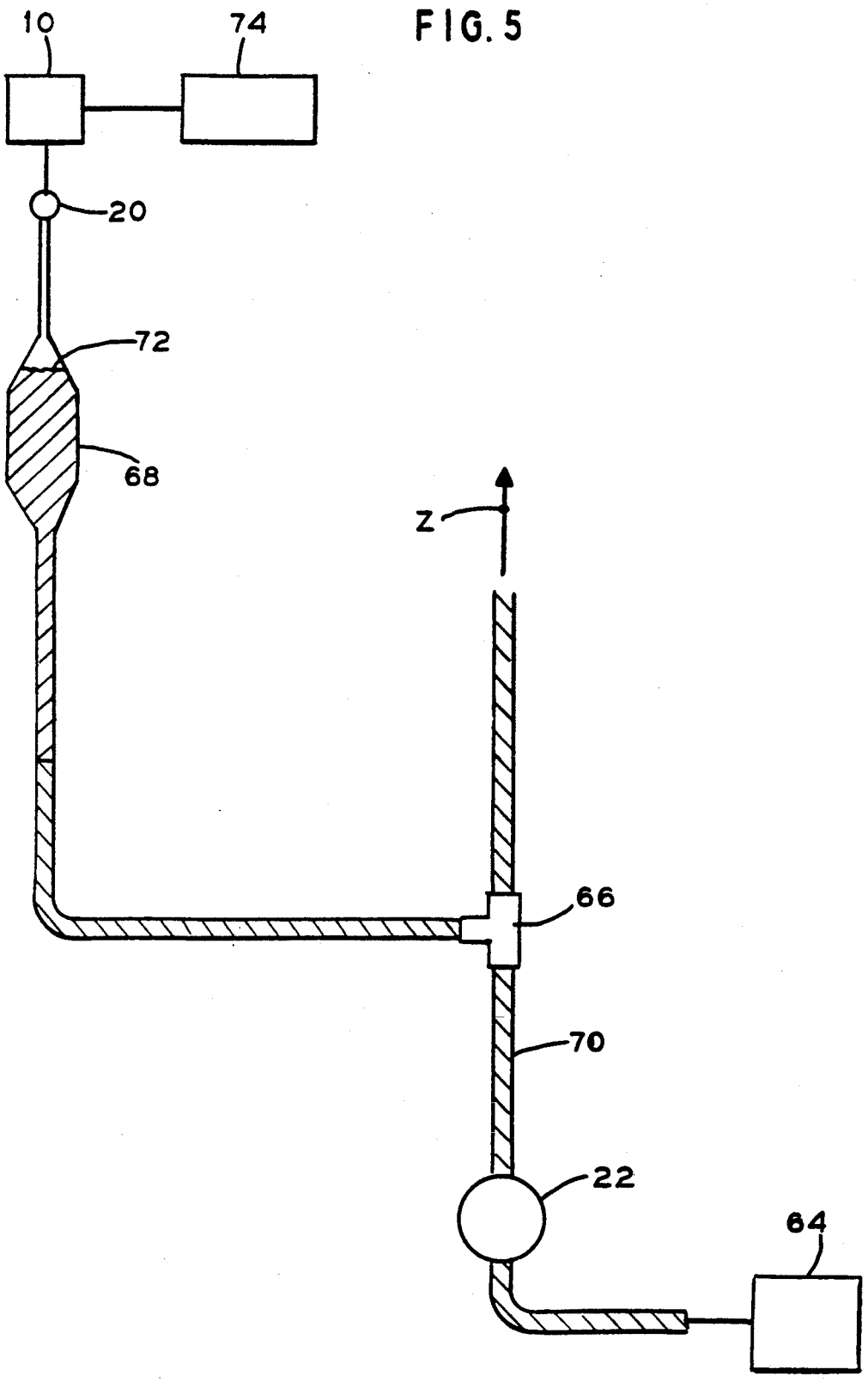
FIG. 5 is an embodiment of the invention.

FIG. 5 shows the monitoring apparatus 10 in an industrial setting. In the non-limiting example depicted, a fluid 70 from a supply source 64 is expressed by the pump 22 toward its ultimate destination as shown by the arrow Z. A "T" connection 66 branches off to a vertically disposed expansion chamber 68. A transducer 20 is affixed to the expansion chamber 68 and in turn communicates with the monitoring apparatus 10. A known quantity of oil 72 or other suitable fluid is stored in the expansion chamber 68.

When the pump 22 is operating normally; that is, when it is pulsating with a normal cadence, generating a stable, pulsating pressure the fluid 70 in the T connection 66 branch will transmit the pulsating pressure changes to the oil 72, and in turn to the transducer 20 in the chamber 68 via the trapped air.

The transducer 20 will convert the mechanical oscillatory pressures originating from the pump 22 to an associated electrical signal which will cause the LED D9 (18) to blink in a recognizable pattern indicating proper operation. The LED D7 (34) will continuously glow. The LED 64 will be off. The threshold pressure output of the pump 22 is necessary to initiate the operation of the apparatus 10 may be regulated by adjusting the setting of the potentiometer 42.

In an operation including numerous pump monitoring apparatus 10, the control panel 74 will include the corresponding number of flashing lights, each LED D9 (18) and LED D5 (64) labelled to indicate the location of its associated pump 22.

In the event of a pump failure, valve breakdown, loss of fluid, etc. the appropriate LED D9 (18) will turn off indicating a pump failure or a line closure or blockage downstream that particular pump or remain continuously on indicating a line blockage downstream the pump. In either case, the monitoring apparatus will sense the change in LED D9's (18) blinking pattern, activate the LED D5 (64) extinguish the green normal LED D7 (34) and activate the red warning LED D8 (36) and the audible warnings from speaker 50 and/or buzzer 62.

Aroused by the cacophony and change in the lights (34 and 36), the operator can quickly identify by visual inspection which LED D9 (18) is not blinking normally and take steps to rectify the situation. The din can then easily be subdued by depressing the reset switch SW1.

The economical monitoring apparatus 10 meets the following design criterion: Motorola® MPX201dp pressure transducers 20 were utilized. An LMI® pump was monitored.

1) Compatible with the analog transducers yet provide the appropriate digital output signal.
2) Low maintenance and upkeep.
3) Low cost.
4) Simple so that accessories could be added if required; e.g. alarms, etc.
5) Versatile so that it could be adapted to various applications.
6) Constructed of readily available components so that the delay time for replacement would be minimized.
7) Modular so that if one channel went down or was serviced the others would not be affected.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A pump monitoring apparatus, the apparatus comprising:

a) a transducer adapted to respond to the regular pulsations of a pump and generate a first pulsed signal in response thereto;

b) pump monitor means for generating a second pulsed signal in the event the first pulsed signal exceeds a predetermined amplitude;

c) a first light source communicating with the pump monitor means, the second pulsed signal causing the first light source to regularly blink in time with the second pulsed signal;

d) digital pulse timed trigger means for sensing the presence and duration of the second pulsed signal; and e) logic means for electrically recognizing the presence or absence of the second pulsed signal, and generating after a continuous normal signal to a second light source or a warning signal to a third light source in response thereto, the second light source and the third light source being configured not to operate simultaneously.

2. The apparatus according to claim 1 including means for generating an audible warning when the third light source is energized.

3. The apparatus according to claim 1 including a power supply generating a high power voltage, a low reference voltage, and a 0-voltage, the 0 voltage and the low reference being supplied to the transducer.

4. The apparatus according to claim 1 wherein the pump monitor includes and analog/digital converter having a variable input trigger downstream from the transducer, the converter capable of generating a spiked signal.

5. The apparatus according to claim 1 wherein the digital pulse time trigger means includes a first transistor, a second transistor, a timer means, and a variable delay control, the first transistor and variable delay control configured to energize and reset the timer means if pulses of the second pulsed signal occur at intervals shorter than that set by the variable delay control so as to energize the second transistor when the regular pattern of the second pulsed signal is disrupted.

6. The apparatus according to claim 5 wherein the output of the digital pulse timed trigger is connected to a fourth light source, the fourth light source being adapted to be energized only when the second pulsed signal is disrupted.

7. The apparatus according to claim 1 wherein the digital pulse timed trigger means communicates with a gate which controls the second and third light sources.

8. The apparatus according to claim 1 wherein the logic means includes a flip-flop, the second light source communicating with an output of the flip-flop to remain constantly illuminated in response to the continuous normal signal, and a third light source communicating with an output of the flip-flop to remain continuously on in response to the warning signal.

9. The apparatus according to claim 1 wherein a gated oscillator is associated with the third light source so as to energize an audible warning device.

10. The apparatus according to claim 9 including a third transistor and a second timer means to cause a speaker to audibly oscillate in tone when the third light source is energized.

11. The apparatus according to claim 1 including a differentiator and ana isolator/inverter interposed between the pump monitor means and the digital pulse timed trigger means.

12. The apparatus according to claim 1 wherein the transducer is associated with an expansion tank filled with a fluid, the expansion tank being flowably connected to the output of the pump being monitored.

* * * * *